United States Patent [19]

Flaig et al.

[11] Patent Number: 4,528,952

[45] Date of Patent: Jul. 16, 1985

[54] EMERGENCY CONTROL DEVICE FOR FUEL-DOSING SYSTEMS

[75] Inventors: Ulrich Flaig, Margröningen; Albrecht Sieber, Böblingen, both of Fed. Rep. of Germany

[73] Assignee: Robert Bosch GmbH, Stuttgart, Fed. Rep. of Germany

[21] Appl. No.: 542,067

[22] Filed: Oct. 14, 1983

[30] Foreign Application Priority Data

Oct. 15, 1982 [DE] Fed. Rep. of Germany ..... 3238191

[51] Int. Cl.[3] ..... F02D 31/00

[52] U.S. Cl. ..... 123/359; 123/198 D

[58] Field of Search ..... 123/359, 357, 358, 479, 123/198 D

[56] References Cited

U.S. PATENT DOCUMENTS

| | | | |
|---|---|---|---|
| 3,699,935 | 10/1972 | Adler et al. | 123/358 |
| 3,834,361 | 9/1974 | Keely | 123/479 |
| 3,911,883 | 10/1975 | Williams et al. | 123/357 |
| 4,372,266 | 2/1983 | Hiyama et al. | 123/357 |
| 4,414,949 | 11/1983 | Honig et al. | 123/479 |

FOREIGN PATENT DOCUMENTS

| | | | |
|---|---|---|---|
| 3130094 | 2/1983 | Fed. Rep. of Germany | 123/359 |
| 210133 | 12/1982 | Japan | 123/359 |

*Primary Examiner*—Magdalen Y. C. Moy

*Attorney, Agent, or Firm*—Michael J. Striker

[57] ABSTRACT

Disclosed is an emergency control device for fuel dosing systems of IC engines, particularly for fuel injection devices of a diesel engine. A conventional regulating path for the fuel pump, includes a series connection of a set of data sensors, a signal processing circuit for computing a regular control signal, and a fuel regulating device connected to the fuel pump and provided with a manually or automatically controlled switching device. An emergency control branch is connected between the switching device and the sensor to function in parallel with the regular regulating device. The emergency control branch includes a nominal value generator of a signal corresponding to a maximum manifold pressure and a manifold pressure regulator controlled by output from the nominal value transmitter, to apply, via the switching device, to the fuel pump a dosing signal which causes the manifold pressure not to exceed the preset maximum value. In a further elaboration the emergency control branch includes a minimum value selector cooperating, in addition to the manifold pressure regulator, with a current control unit indicative of the gas pedal position and with an overspeed safety circuit cooperating with a rotary speed sensor. A maximum value selector is connected between the switching device and the output of the minimum value selector and controls the dosing pump in response to an idling speed stabilizer.

7 Claims, 1 Drawing Figure

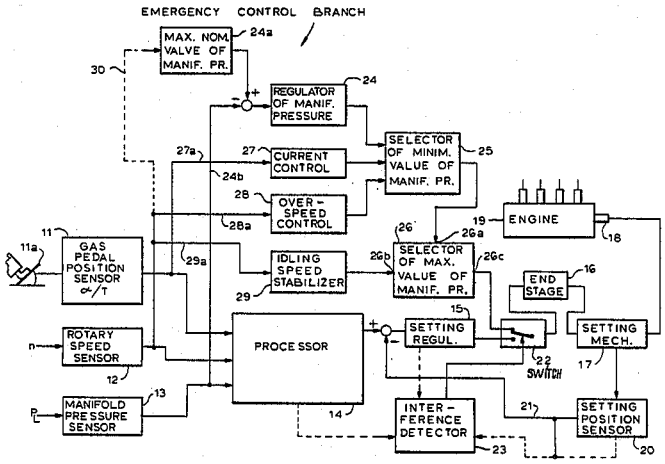

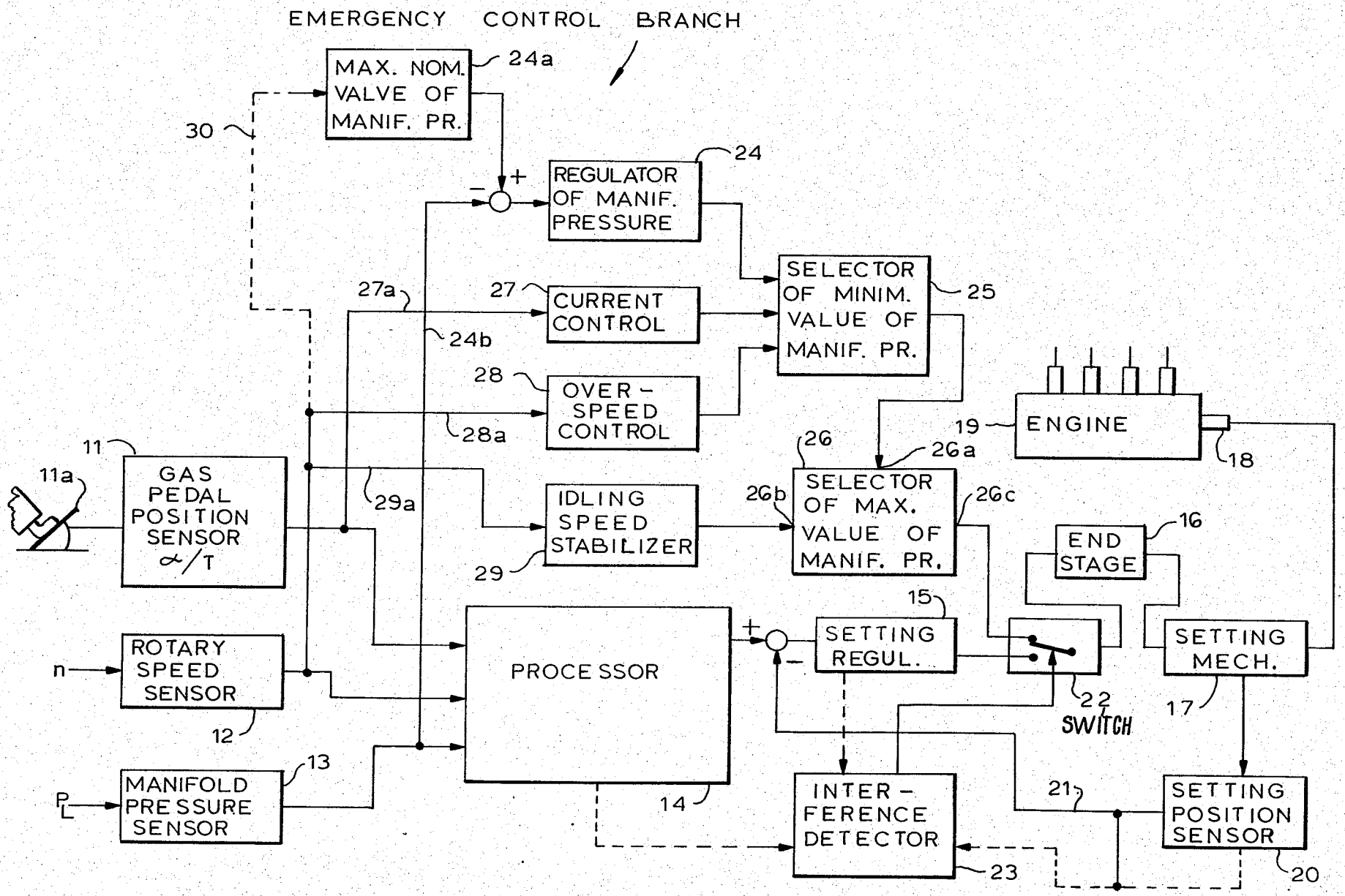
EMERGENCY CONTROL BRANCH
MAX. NOM. VALVE OF MANIF. PR.
24a
30
REGULATOR OF MANIF. PRESSURE
24
CURRENT CONTROL
27
27a
OVER-SPEED CONTROL
28
28a
IDLING SPEED STABILIZER
29
29a
SELECTOR OF MINIM. VALUE OF MANIF. PR.
25
SELECTOR OF MAX. VALUE OF MANIF. PR.
26
26a
26b
26c
ENGINE
19
18
END STAGE
16
SETTING MECH.
17
SETTING POSITION SENSOR
20
SWITCH
22
21
SETTING REGUL.
15
INTER-FERENCE DETECTOR
23
PROCESSOR
14
GAS PEDAL POSITION SENSOR α/T
11
11a
ROTARY SPEED SENSOR
12
n
MANIFOLD PRESSURE SENSOR
13
P_L

EMERGENCY CONTROL DEVICE FOR FUEL-DOSING SYSTEMS

BACKGROUND OF THE INVENTION

The present invention relates in general to an emergency control device for a fuel-dosing system of an internal combustion engine, particularly for a fuel injection system of a diesel engine. The fuel-dosing system is of the type which includes at least a sensor of the gas pedal position, means for processing the signal from the sensor, a fuel regulating device controlled by the signal processing means and including a setting mechanism for positioning both setting members of a fuel pump.

In electrically or electronically controlled fuel injection arrangements or systems as used for example in diesel engines, safety devices are known which in the case of a malfunction are activated to provide for an emergency operation of the engine and protect the same against overload. For example, from the German publication No. 1 962 570 a resetting device for a dosing member of fuel injection system is disclosed which is activated in response to the occurrence of a defect such as for example when the regulating circuit itself or a conduit from one of its sensors is interrupted. Upon the activation of the resetting device, the dosing member is adjusted so as to supply smaller amounts of injected fuel. This known device however has the disadvantage that due to the aforementioned adjusting measures in the direction to lower amounts of supply of fuel the output of the engine can be reduced to such an extent that if the vehicle operates in a difficult terrain, for example, the operation of the engine can no longer be maintained.

Accordingly there is a need for an emergency control device for fuel-dosing systems, particularly fuel injection systems which guarantees that the engine is protected under all circumstances against overspeed, that excessive doses of fuel are avoided and at the same time the controllability of the vehicle by the operator is maintained under emergency operational conditions and without larger impairment of the overall operation.

SUMMARY OF THE INVENTION

It is therefore a general object of the present invention to overcome the disadvantages of the prior art emergency control systems.

More particularly, it is an object of the invention to provide an improved emergency control system which reliably protects the engine against overspeed and enables a perfect idling speed stabilization.

An additional object of the invention is to provide such an improved emergency device which enables not only the direct control by the operator of the vehicle by activating the gas pedal but it also brings into action an auxiliary regulation which utilizes the intake manifold pressure for the emergency control. The invention makes it possible to limit the amount of injected fuel in such a manner that the auxiliary regulating circuit first presets a desired value of the intake manifold pressure and a regulator of the intake manifold pressure than adjusts the amount of adjusted fuel to this desired value.

A particularly advantageous application of this invention is in a fuel injection system in which the injected fuel dose is determined by a setting mechanism having a position feedback; in the case of a failure of this checkback position indicator, the actual value signal to be applied to the setting regulator is lost in the regulating path and an exact dosing of the fuel to be injected can no longer take place. This invention introduces the intake manifold pressure as a substitute signal for the regulating path thereby securing the emergency operation by regulating the intake manifold pressure.

In a further elaboration of this invention the regulation of the intake manifold pressure for determining the fuel injection dose is supplemented by additional or auxiliary control signals which are derived from operational conditions of the IC engines. These additional signals which in the case of failure of the checkback position sensor alone are always available and can be integrated in the entire emergency control procedure so that both reliable idling speed and overspeed protection are secured and at the same time the operators commands, as far as the emergency mode of operation permits, can be observed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE shows in a block circuit diagram the construction and function of a fuel injection system complemented with emergency control system designed for a parallel function.

DESCRIPTION OF THE PREFERRED EMBODIMENT

Reference numerals 11, 12 and 13 indicate respectively a position sensor for a gas pedal 11*a*, a rotary speed sensor and a manifold pressure sensor. The output signals from these sensors are applied to a logic data processing circuit which may be in the form of a microcomputer or similar computing device which is programmed for computing, from the data supplied by the sensors, the desired value of the amount of fuel to be injected in the engine during its normal operation. This example refers specifically to the operation of a diesel engine provided with a supercharger or so-called turbo supercharger and a control circuit for the supercharger-pressure (intake manifold-pressure regulator). In supercharged diesel engines it is conventional to operate with as a high supercharger pressure as possible, whereby a variation of the supercharger pressure especially due to the load and rotary speed is taken into account in order to find an optimum compromise for each operational point of the IC engine and to utilize to full extent the advantages of the turbo supercharger. Conventionally, the regulation of the supercharger or intake manifold pressure $p_L$ generated by the turbo supercharger is performed via a by-pass valve whose more or less wide opening causes the corresponding changes in the rotary speed of the turbo supercharger.

In normal operation of a fuel injection system, as mention above, a group of external sensors 11, 12 and 13 which detect the operational conditions of the engine, are connected to the logic data processing circuit 14 and computed desired value of the dose is applied via a setting regulator 15 and a power end stage 16 to the actual setting mechanism 17 which controls the dosing member 18 of a fuel injection pump 19. The detailed construction and function of the aforedescribed circuit elements and peripheral components need not be described in detail since these component parts are well known in the art of fuel injection systems and do not participate in this invention. The position of the dosing member 18 is sensed by a position sensor 20 whose output signal is fed via a feedback conduit 21 to the input of a setting regulator 15.

Contingent events necessitating an emergency mode of operation may occur for instance due to a defective checkback position sensor inasmuch in this case no accurate dosing of the fuel can take place, or during errors in the computing or data processing circuit 14 or in the setting regulator 15. Such interferences can be recognized by the operator of the engine and a manual switch-over from the normal to the emergency operation can be made by means of a switch 22 arranged between the setting regulator 15 and the end stage 16. Another switch over of signals due to the data processing circuit 14, setting regulator 15 and the position checkback sensor 20 will be described below. The switch over also can be made automatically by means of an interference detecting circuit 23 which receives input signals indicative of a regular operation from the data processing circuit 14, setting regulator 15, the position sensor 20 and the feedback conduit 21 and whose output controls the switching device 22 to actuate the same in the case of a detected emergency.

A substantial component part of the emergency control circuit is an intake manifold (supercharger)-pressure regulator 24 which determines by regulating the amount of fuel the supercharger pressure of the diesel engine. For this purpose there is provided a nominal value transmitter **24*a* delivering a maximum desired or nominal value of the supercharger pressure for the emergency mode of operation. The actual value of the supercharger pressure delivered by the sensor 13 is applied at a subtraction point to the output of the nominal value transmitter 24*a* and the difference signal is applied to the supercharger pressure regulator 24. The output from the regulator 24 can in the simplest case be applied directly to the switching device 22 wherefrom it is fed through the power end stage 16 to the setting mechanism 17 which adjust in the aforedescribed manner the dosing operation of pump 19**.

In a further elaboration of this invention, the overall operational conditions of the engine are considered and to this end there are provided two selectors 25 and 26 of which the selector 25 selects the minimum value and the selector 26 the maximum value of the supercharger pressure. The emergency control system of this invention further includes a current control 27 which produces an output signal corresponding to an arbitrary gas pedal position set by the operator. The gas pedal position sensor 11 therefore is also connected via a branch conduit **27*a* to the input of the current control unit 27. The sensor 11 can be in the form of a pedal angle cycle or frequency converter. Furthermore, in order to obtain a reliable overspeed protection, it is advisable to provide a selective circuit 28 whose input is connected via a branch conduit 28*a* to the output of the speed sensor 12. The same signal from the sensor 12 is also applied via a conduit 29*a* to the input of an idling speed stabilizer 29**.

The outputs of supercharger pressure regulator 24, current control unit 27 (taking into consideration the intentions of the operator), and the overspeed safety device 28 are connected to respective inputs of the minimum value selector 25. In the latter circuit the input signals, in this example three signals, are compared with each other and the signal which has the lowest value is passed to the output. Consequently, it is guaranteed that even in the case when the operator, for example, intends to feed in the control circuit substantially large signals corresponding to a substantially larger dose of injected fuel than permitted by the supercharger pressure regulator (the latter signal in this case is smaller than that of the current control unit 27 or of the overspeed safety unit 28), then the lowest output signal from the regulator 24 prevails and protects the engine against excessive power or overspeed and fuel overdosing.

The output of the minimum value selector 25 is connected to one input **26*a* of a maximum value selector 26 whose other input 26*b* is connected to the output of the idling speed stabilizer 29. The purpose of this maximum value selector is to save gas at a predetermined idling rotary speed limit below which the speed of the engine must not fall. The maximum value selector 26 thus prevents a situation when the engine is under the influence of one of the control units 24, 27 and 28, in which the supercharger pressure is continuously controlled to lower and lower values at which the idling speed might drop to lower point at which the engine stalls. The output signal from the maximum value selector 26 is fed via conduit 26*c* to the switching device 22**. The maximum value selector thus constitutes the last member in the regulating path of the emergency control device of this invention.

In accordance with the basic concept of this invention the output signal of the sensor 13 corresponding to the actual value of the supercharger pressure is applied in the case of an emergency as a substitute signal replacing that of the defective regulating path. The regulation of the supercharger pressure guarantees a reliable and flawless maintenance of the emergency mode of operation of the engine. The amount of injected fuel is limited by means of a preset signal at the output of terminal value transmitter **24*a* corresponding to a maximum nominal value of the supercharger pressure. The supercharger pressure regulator 24** takes care that this maximum nominal value be not exceeded. This nominal value can amount for example to 1 bar corresponding to the operational conditions of a suction engine.

In a modified embodiment of this invention, the maximum nominal value of the supercharges pressure generated in the transmitter **24*a* is adjustable. As indicated by dash-connection line 30 leading to the output of speed sensor 12, the output signal from the maximum nominal value transmitter 24*a* can be made dependent on the rotary speed signal. As a consequence, the supercharger pressure regulator 24 can permit sufficiently high supercharger pressure as required for a pollution-free and fuel saving operation of the engine as long as the rotary speed signal is below a value at which overspeed might result. If the IC engine starts operating in the range of excessive speed, then the increased signal in conduit 30** causes the readjustment of the maximum nominal value of the manifold pressure leading to a corresponding reaction dosing of fuel supplied to the engine.

The construction and function of the supercharger pressure regulator is not critical for this invention, and the regulator 24 can exhibit a $P_{-1}$, D- or I-behavior or a combination of the latter functions.

It will be understood that each of the elements described above, or two or more together, may also find a useful application in other types of constructions differing from the types described above.

While the invention has been illustrated and described as embodied in a specific example of an emergency control circuit for use with a diesel engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An emergency control device for a fuel dosing system of an internal combustion engine, particularly for a fuel injection system of a diesel engine, including at least a gas pedal position sensor, means for processing a signal from the sensor into a control signal, regulating means responsive to the control signal, the regulating means controlling a setting mechanism for positioning an adjusting member of a fuel pump, comprising a switching device connected to an input of said setting mechanism, an emergency control branch including means for transmitting a signal corresponding to a maximum nominal value of manifold pressure of the engine, a manifold pressure regulator controlled by said maximum nominal value signal and having its output connected to said switching device so as to apply, in the case of an emergency, said output signal corresponding to the maximum permissible manifold pressure, to said setting mechanism.

2. An emergency control device as defined in claim 1 further comprising a manifold pressure for delivering a signal corresponding to an actual value of the manifold pressure, means for combining said maximum nominal value signal with the actual value manifold pressure signal and applying the resulting signal to an input of said manifold pressure regulator so that in the case of a failure of said regulating means the output signal from the manifold pressure regulator is applied as a substitute control signal via said emergency branch.

3. An emergency control device as defined in claim 2 wherein said regulating means includes a position sensor of said fuel pump adjusting member.

4. An emergency control device as defined in claim 2, further comprising a minimum value selector having a plurality of inputs and an output connected to said switching device, a current control unit responsive to said gas pedal position sensor, a rotary speed sensor and an overspeed safety circuit connected to the speed sensor, said manifold pressure regulator, said current control circuit and said overspeed safety circuit each having an output connected to an assigned input of said minimum value selector to apply, in the case of an emergency mode of operation of the engine a minimum input signal to said setting mechanism.

5. An emergency control device as defined in claim 4 further comprising an idling speed stabilizer having its input connected to said rotary speed sensor, a maximum value selector having one input connected to the output of said idling speed stabilizer, and its other input connected to said minimum value selector, the output of said maximum value selector being connected to said switching device to apply, in the case of an emergency mode of operation of the engine, a maximum input signal to said setting mechanism so as to automatically increase the dosing of said fuel pump when the idling speed of the engine drops below a certain limit value.

6. An emergency control device as defined in claim 5 wherein said means for transmitting the signal corresponding to a maximum nominal value for said manifold pressure includes a control input connected to said rotary speed sensor to adjust the maximum value of the manifold pressure in response to a preset overspeed signal.

7. An emergency control device as defined in claim 3, further comprising an interference detector responsive to interference in said processing means in said position sensor of the fuel pump adjusting member and in said regulating means, said interference detector generating in the case of an interference an output signal for switching over the switching device from its normal operational condition to its emergency operational condition.

* * * * *